United States Patent [19]

Giebel

[11] Patent Number: 4,853,997

[45] Date of Patent: Aug. 8, 1989

[54] MACHINE FOR LASTING SIDE PORTIONS OF SHOE UPPERS

[75] Inventor: Gerhard Giebel, Bad Soden, Fed. Rep. of Germany

[73] Assignee: DVSG Patentverwaltungs GmbH, Frankfurt am Main, Fed. Rep. of Germany

[21] Appl. No.: 290,874

[22] Filed: Dec. 28, 1988

Related U.S. Application Data

[63] Continuation of Ser. No. 130,737, Dec. 9, 1987, abandoned.

[30] Foreign Application Priority Data

Dec. 10, 1986 [DE] Fed. Rep. of Germany ..... 3642239

[51] Int. Cl.[4] ..... A43D 21/00

[52] U.S. Cl. ..... 12/8.3; 12/13.1

[58] Field of Search ..... 12/8.3, 7, 12.1, 13.1

[56] References Cited

U.S. PATENT DOCUMENTS

| | | | |
|---|---|---|---|
| 3,579,692 | 5/1971 | Muhlbach et al. | 12/8.3 |
| 3,803,654 | 4/1974 | Henkel et al. | 12/8.3 |
| 3,971,089 | 7/1976 | Gadd et al. | 12/8.3 |
| 4,078,274 | 3/1978 | Fichtner | 12/8.3 |
| 4,319,373 | 3/1982 | Lauckhardt et al. | 12/8.3 |
| 4,491,997 | 1/1985 | Price | 12/13.1 |
| 4,630,325 | 12/1986 | Bender et al. | 12/13.1 |

FOREIGN PATENT DOCUMENTS

| | | |
|---|---|---|
| 247831 | 10/1984 | European Pat. Off. . |
| 123471 | 12/1987 | European Pat. Off. . |
| 1817915 | 10/1975 | Fed. Rep. of Germany . |
| 2126870 | 4/1984 | United Kingdom . |
| 2052950 | 2/1987 | United Kingdom . |

*Primary Examiner*—Steven N. Meyers

*Attorney, Agent, or Firm*—Owen J. Meegan; Aubrey C. Brine

[57] ABSTRACT

In a side (or side and seat) lasting machine two side lasting assemblies (230) are provided each comprising a side lasting roll (276) having a helical wiper element (282). As the rolls (276) are caused to operate progressively along opposite side portions of the shoe bottom from the heel breast line region toewardly, they are caused to rotate thus effecting an inwiping action on the lasting margin and pressing it against the insole margin. At a predetermined point in such progressive operation, at least one of the rolls (276) is displaced axially inwardly towards one another to enhance the inwiping action. This axial displacement may take plate at the ball region of the shoe bottom, i.e. at or just before the end of the operation, and only the "outside" roll (276) or both rolls (276) may be so displaced. Alternatively the "outside" roll (276) may be displaced when it has reached the waist region, and in addition, if desired, the "inside" roll (276) in such circumstances is displaced axially inwardly at the start of the lasting operation.

10 Claims, 6 Drawing Sheets

MACHINE FOR LASTING SIDE PORTIONS OF SHOE UPPERS

This application is a continuation of application Ser. No. 130,737, filed Dec. 9, 1987, now abandoned.

BACKGROUND OF THE INVENTION

This invention is concerned with a machine for lasting side portions of shoe uppers comprising a shoe support for supporting, bottom uppermost, a shoe comprising a shoe upper on a last with an insole on the last bottom, side lasting instrumentalities comprising two wiper assemblies, arranged one at each side of the shoe support and each comprising a rotary lasting roll extending transversely of the shoe bottom and having a helical wiping element which engages the shoe upper for effecting an in-wiping force thereon as the roll rotates, together with means for effecting rotation of the rolls, and means for effecting relative movement, lengthwise of the shoe bottom, between the shoe support and the side lasting instrumentalities to cause the lasting rolls to operate progressively along opposite side portions of the shoe bottom.

One such machine is disclosed in DE-C 1817915, in the operation of which machine the lasting rolls, forming part of the side lasting instrumentalities, operate along opposite marginal portions of the shoe bottom from the region of the heel breast line toewardly, the helical wiping element of each roll serving to in-wipe the lasting margin and to press it against the insole, to which it is secured by previously applied adhesive. In other machines, e.g. the machine disclosed in US-A No. 4435869, lasting rolls are again used having helical wiping elements, but in this case they are caused to move heelwardly from a region of the forepart of the shoe bottom which has previously been lasted, the wiping elements again serving to in-wipe and press the lasting margin against the insole to secure it thereto by previously applied adhesive.

In the latter machine, the final stage of lasting the shoe is constituted by a heel seat lasting operation in which, using wiper plates, the shoe upper material constituting the lasting margin is wiped over the insole edge and secured and any excess material is distributed in the form of pleats over the marginal surface of the insole; in this way, no significant loops or folds are formed in the upper material. It will of course be appreciated that excess material frequently arises because of the shape of the upper and the need for it to conform to the shape of the last such that the lasting margin of the upper can be secured satisfactorily to the insole.

Where the operation takes place from the heel breast line region toewardly, as e.g. in the machine disclosed in DE-C No. 1817915, the excess material again arises and, where the forepart of the shoe upper has already been lasted, an unwanted fold often arises at the "boundary" between the lasted forepart portion and the progressively lasted side portion. Such a fold is very undesirable not only from a shoe-making point of view, in that it renders difficult subsequent treatment of the marginal portion of the shoe bottom, e.g. roughing and sole attaching operations, but also in that excess material in the ball region of the shoe can cause discomfort to the wearer.

Where it is desired to combine a side lasting operation using lasting rollers of the above kind with a heel seat lasting operation, it is of course desirable to operate from the heel breast line toewardly with the side lasting instrumentalities in order to "clear" the heel seat for the heel seat lasting operation, so that the overall time taken for the heel seat lasting and side lasting operations can be reduced. It will thus be appreciated that it is undesirable in such "combination" machines for the side lasting operation to take place from the boundary of the previously lasting forepart operation heelwardly, since in such circumstances it would not be economically acceptable to delay the heel seat lasting operation until the side lasting operation is completed.

OBJECT OF THE INVENTION

It is thus the object of the present invention to provide an improved machine for lasting side portions of shoe uppers, in the operation of which the formation of folds in the region where the side lasting operation is terminated can be mitigated, if indeed not avoided.

SUMMARY OF THE INVENTION

This object is resolved in accordance with the present invention, in a machine as set out in the first paragraph above, in that at least one of the lasting rolls, when it has reached a predetermined region in operating progressively along the shoe bottom as aforesaid, is displaced axially inwardly in a direction towards the other roll.

It will thus be appreciated that, using a machine in accordance with the invention, the in-wiping force applied by the said one lasting roll is enhanced in said predetermined region by bodily displacing it axially inwardly, such inward displacement serving to tighten the upper over the insole edge in said region and spread over a wider area the material which could otherwise form the fold, prior to its being secured to the insole.

In one embodiment said one roll which is displaced axially inwardly as aforesaid is constituted by the roll operating on the "outside" margin of the shoe bottom, the arrangement being such that it is so axially displaced when it reaches the ball region of the shoe bottom. If desired, furthermore, both rolls may be displaced axially as aforesaid when they reach the ball region of the shoe bottom.

In a second embodiment, said one roll which is displaced axially inwardly as aforesaid is constituted by the roll operating on the "outside" margin of the shoe bottom, the arrangement being such that it is so axially displaced when it reaches the waist region of the shoe bottom. Furthermore in a machine wherein the lasting rolls are mounted for pivotal movement about a heightwise axis thus to effect movement thereof, lengthwise of the shoe bottom, relative to the shoe support whereby the rolls are caused to operate progressively along opposite marginal portions of the shoe bottom as aforesaid, and wherein the axis of each roll as it pivots, passes through a position coincident with a perpendicular to the longitudinal centre line of the operating locality of the machine, the axial displacement of the roll takes place when it reaches the aforementioned position.

In each of the aforementioned embodiments, advantageously as inward displacement movement of the (or each) lasting roll is effected as aforesaid, the speed of relative movement between the shoe support and the side lasting instrumentalities may be reduced, or if desired the relative movement may be arrested. In this way, the lasting roll "dwells" at the point where the fold could otherwise arise and, by continued rotation of the helical wiping element, enhance still further the already enhanced in-wiping drafting force and the spreading of the upper material as aforesaid.

In a third embodiment, which is a modification of the second embodiment, the other roll, which operates along the "inside" margin of the shoe bottom, is also displaced axially inwardly in response to its having been brought into engagement with the shoe bottom. Furthermore, in a machine wherein a sensing finger is associated with each roll and is effective, upon sensing the edge of the shoe bottom by engagement therewith as the roll is moved into operative position, to arrest such movement, thus determining said operative position, conveniently the inward axial displacement of the "inside" roll takes place in response to the sensing finger sensing the edge of the shoe bottom as aforesaid.

Whereas the present invention is applicable to side lasting machines in which the lasting margin is secured to the insole margin by means of adhesive previously applied therebetween, in a preferred embodiment the side lasting instrumentalities comprises two fastener-inserting tools, one associated with each lasting roll, each roll and its associated tool being movable together transversely of the shoe bottom whereby to follow the contour thereof, e.g. a so-called tack side lasting machine of the type generally as described in EP-A No. 0123471 (although it is pointed out that that utilises lasting bands, but rather than lasting rolls). In such preferred embodiment, furthermore, in effecting its axial displacement movement, each roll moves inwards relative to its associated tool. In this way, the tool still remains in the correct orientation in relation to the contour of the shoe bottom so that it can insert a fastener at the appropriate position in relation to the insole edge even in the predetermined region at which the inward displacement movement of its associated roll takes place.

Whereas the invention is of particular benefit in a "combination" machine, and in particular a combination side and heel seat lasting machine, nevertheless it will be appreciated that benefits accrue from the invention in a machine for lasting side portions only of the shoe upper. Furthermore, whereas reference has been made to the benefits in a machine in which the lasting rolls operate from the heel breastline region toewardly up to a "boundary" with a previously lasted forepart portion, it will be appreciated that similar benefits would arise where the heel seat portion has been lasted first and the direction in which the lasting rolls progress is from the ball region heelwardly to the "boundary" with the previously lasted heel seat region.

BRIEF DESCRIPTION OF THE DRAWINGS

There now follows a detailed description, to be read with reference to the accompanying drawings, of one side and seat lasting machine in accordance with the invention, which machine has been selected for description merely by way of non-limiting example of the invention.

In the accompanying drawings.

DESCRIPTION OF THE PREFERRED EMBODIMENT

Figure 1:
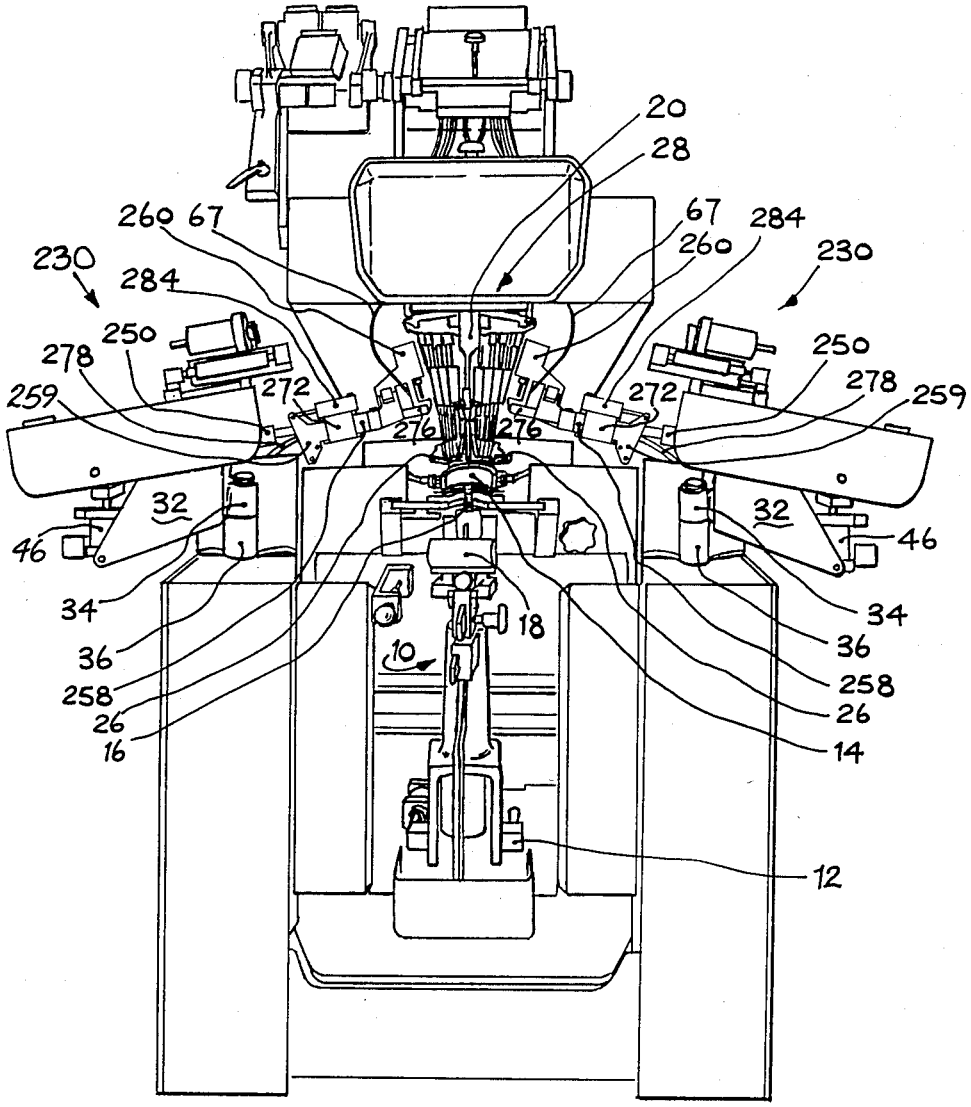
FIG. 1 is a perspective view of the machine in accordance with the invention.

The machine now to be described is a machine for lasting side and heel seat portions of shoes and is generally similar, except as hereinafter described, to the second of the two machines disclosed in EP-A No. 0247831 (itself being a modification of the machine described in EP-A No. 0123471). Thus, the machine comprises a shoe support 10 mounted for movement about a horizontal axis 12 between a shoe loading position and the operating locality of the machine in which the heel end portion of a shoe S supported thereby is embraced by a heel band 14 forming part of heel seat lasting instrumentalities of the machine, said band 14 determining the lengthwise disposition of the shoe in the machine. The shoe support 10 comprises a heel pin 16 and a toe rest 18 whereby the shoe can be supported bottom up. For determining the heightwise disposition of the shoe in relation to the heel seat lasting instrumentalities, a hold-down 20 is also provided.

The machine also comprises heel seat lasting instrumentalities comprising a wiper assembly 26, comprising a pair of wiper plates by which marginal portions of a shoe upper can be wiped over and secured to corresponding marginal portions of the insole of the shoe, said assembly and its operation being fully described in GB-A 2052950. In addition, the heel seat lasting instrumentalities comprise fastener-inserting tools generally designated 28 associated with the wiper assembly in such a manner that, after the over-wiping of lasting marginal portions of the upper, said portions are secured to the insole by fasteners driven thereinto.

Figure 3:
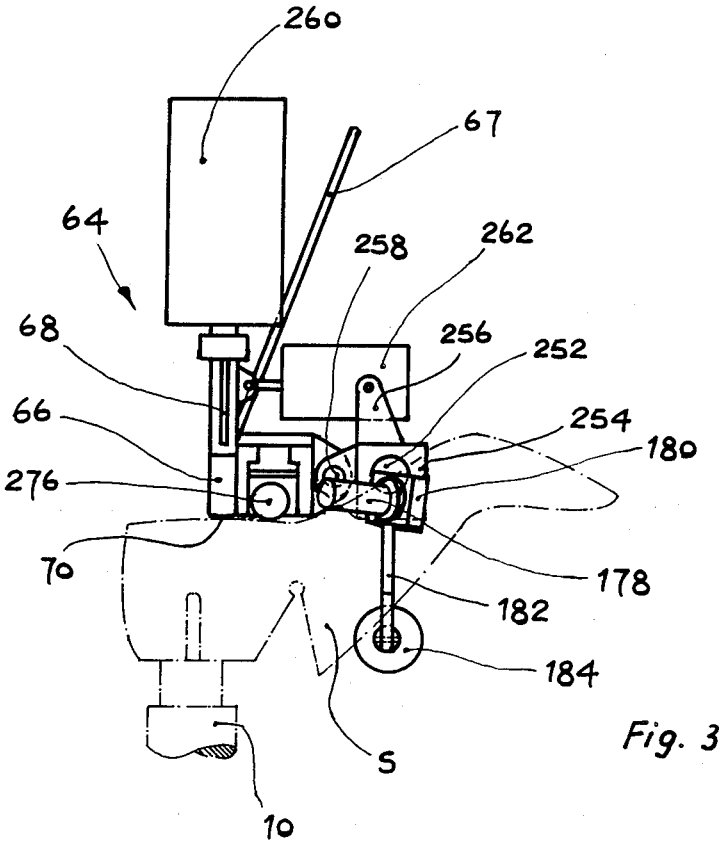
Figure 4:
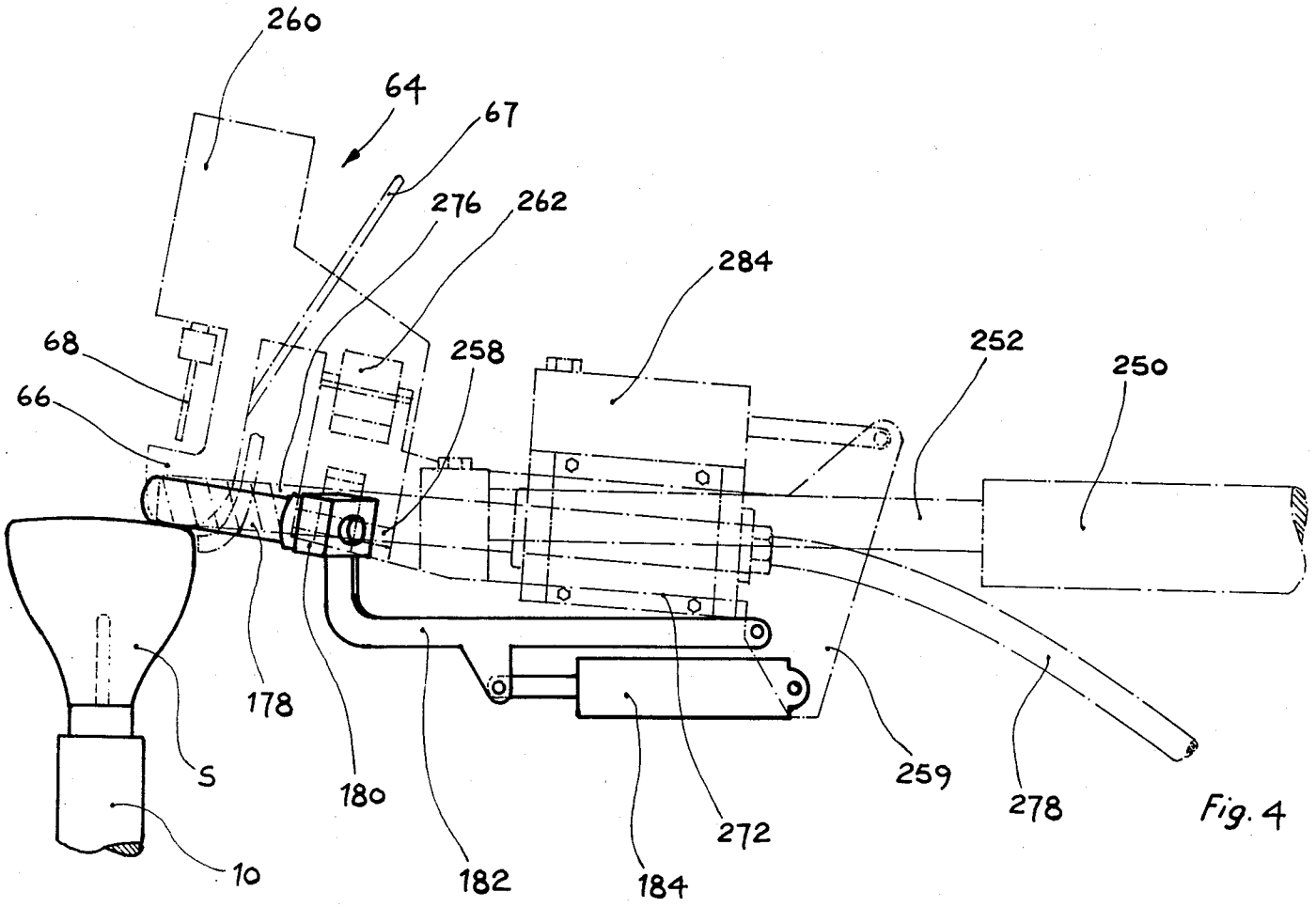
FIG. 4 is a view generally similar to FIG. 2 but showing further details omitted for the sake of clarity from that Figure.
Figure 5:
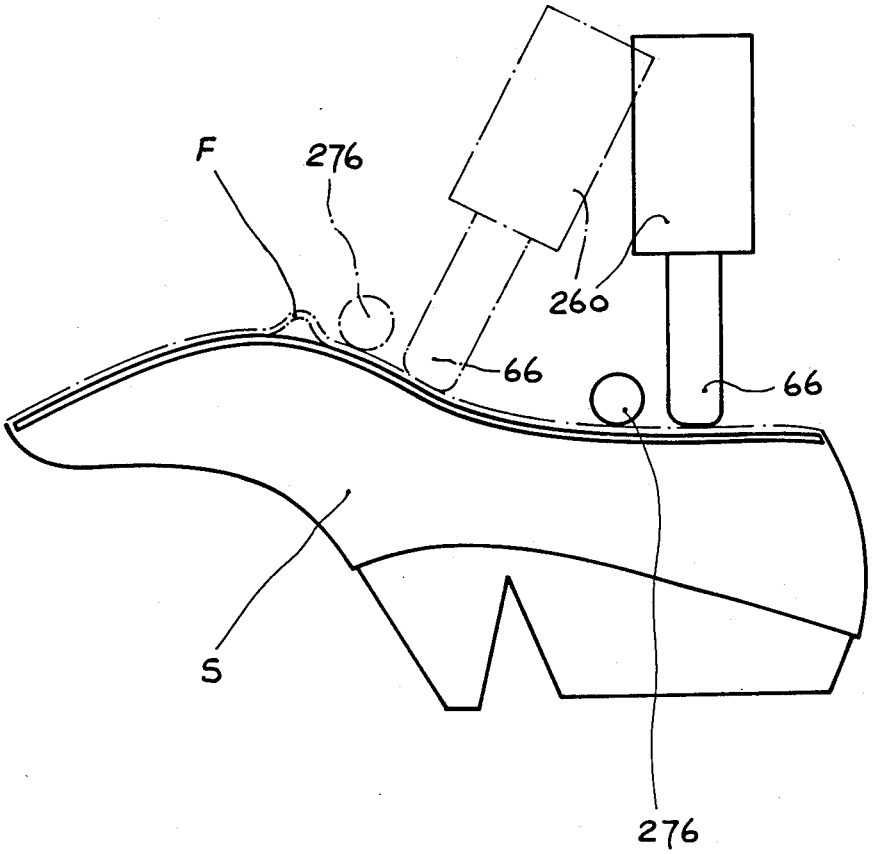
FIG. 5 is a schematic side view of a shoe, illustrating the formation of a fold by a progressively operating side lasting instrumentality.
Figure 6:
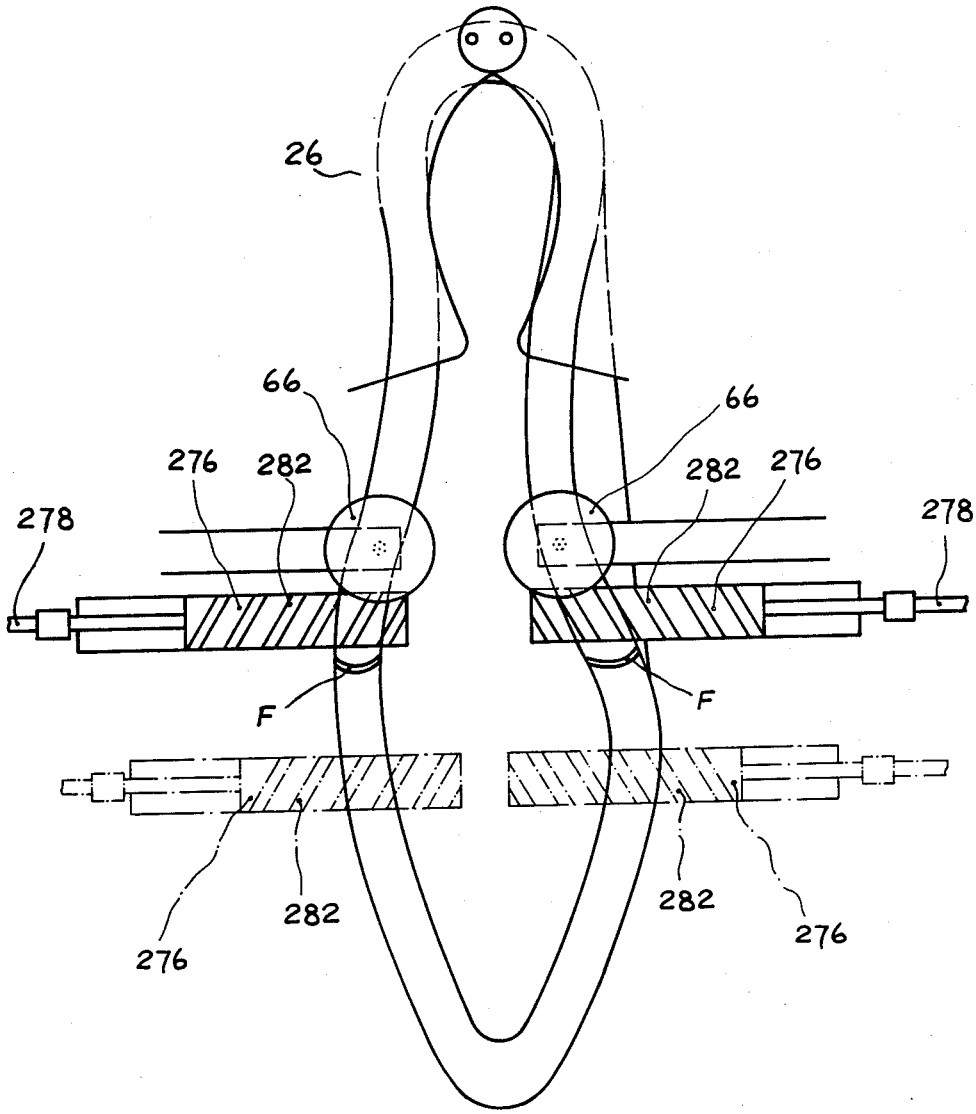
FIG. 6 is a schematic underneath plan view of a shoe bottom illustrating the axial inward displacement of lasting rolls forming part of the side lasting instrumentalities.

The machine further comprises side lasting instrumentalities by which opposite side portions of the shoe upper can be wiped over and secured to corresponding marginal portions of the insole, said side lasting instrumentalities comprising two side lasting assemblies generally designated 230, arranged one at each side of the shoe support 10. The two side lasting assemblies are generally the same, save that one is a left-hand and the other a right-hand, and consequently only one of the assemblies will now be described with reference to FIG. 2 to 4; it will be appreciated that these Figures have been separated in order better to indicate features of the construction of the assembly.

Each side lasting assembly 230 comprises a casting 32 which includes a pivotal mounting 34 by which the assembly 230 is supported on a frame portion of the machine for pivotal movement about a vertical axis whereby the operating elements of the assembly can be caused to move progressively in a direction lengthwise of the shoe bottom whereby, starting from the heel breast line region, a side lasting operation can be progressively effected along the sides of the shoe. For so moving the assembly 230, furthermore, a piston-and-cylinder arrangement (not shown but designated 38 in EP-A No. 0247831) is provided, also mounted on a frame portion of the machine, and having associated therewith a so-called "Hydrocheck" control unit by which the speed at which the operating elements are caused to move progressively along the shoe bottom can be controlled. The casting 32 is provided with a pivot pin (not shown, but designated 42 in EP-A No. 0247831), extending horizontally and normally to the direction of the axis of the mounting 34, for supporting a main support block of the assembly 230, the arrangement being such that the operating elements of said assembly can thus move heightwise of the bottom of a shoe supported by the shoe support. For effecting such heightwise movement, a piston-and-cylinder arrangement 46, is provided, mounted on the casting 32 and acting upon a rearward end portion of an extension rod projecting from the block.

The main support block supports at its opposite end a piston-and-cylinder arrangement 250 having a piston rod 252 projecting forwardly therefrom (to the left viewing FIG. 2), said rod in turn supporting a block 254 at its forward end. Secured to one side of the block 254 is a support block 256 having a pivotal mounting 258 therein for a carrier 260, which is thus mounted for pivotal movement about the axis of said mounting 258. A piston-and-cylinder arrangement 262 is supported by the support block 256 for effecting such pivotal movement.

The carrier 260 supports a fastener-inserting tool 64 (being of the same construction as the tack insertion device 5 described in EP-A No. 0123471), said tool comprising a block 66 in which a fastener (tack) can be received along a supply tube 67 for driving into the shoe, and also in which the leading end of a driver rod 68 is accommodated for driving such fastener. The block 66 also provides a surface 70 which engages the over-wiped lasting marginal portion of the shoe upper to be secured by the fastener. It will be appreciated that because the fastener-inserting tool 64 can pivot about the axis of the pivotal mounting 258 the block 66 can be oriented according to the contour of the shoe bottom, especially in the case of ladies high heeled shoes, it being of course desirable that the tacks are driven perpendicularly, or substantially so, into the shoe bottom.

Also supported by the support block 256, for sliding displacement movement therealong, is a housing 272 for a wiper arrangement generally designated 274, a piston-and-cylinder arrangement 284 being mounted on said housing 272, and its piston rod being connected to an extension 259 of the block 256, thus to displace the wiper arrangement 274 bodily transversely of the bottom of a shoes supported by the shoe support 10, as will be referred to hereinafter. The wiper arrangement 274 comprises a so-called sleeking roll 276 which is generally cylindrical and is provided with a helical wiper element 282, together with means, including a motor (not shown) and a flexible drive shaft 278, for rotating the roll. As the roll 276 is thus caused to rotate the wiper element 282 thereof effects an in-wiping action on the lasting margin and also serves to press the lasting margin against the margin of the insole to secure it thereto. The action of such sleeking rolls is well known, see e.g. DE-C No. 1817915.

It will be appreciated that the side lasting instrumentalities 230 are generally movable in a direction transversely of the shoe bottom to move the operating elements thereof from an initial, out-of-the-way, position into an operative position in which the fastener-inserting tools 64 overlie the marginal portions of the shoe bottom, this movement being achieved by the operation of the piston-and-cylinder arrangements 250. For determining such operative position, each instrumentality 230 also comprises a sensing finger 104 which is pivotally mounted on an extension of the block 66. The finger engages a side portion of the shoe and is thus cammed sideways about its pivot upon such engagement. The opposite end of the finger 104 constitutes an actuator for a microswitch (not shown, but designated 108 in EP-A No. 0123471) which, when actuated, generates a signal to terminate inward movement of the operating elements under the action of the piston-and-cylinder arrangement 250. It will thus be appreciated that, by the provision of the sensing finger 104, the operative position of the fastener-inserting tool 64 can be accurately determined in relation to the edge of the shoe bottom.

In addition there is associated with each roll 276 a non-rotary finger 178 (omitted from FIGS. 1 and 2, but shown in FIGS. 3 and 4) which extends inwardly transversely of the shoe bottom and engages the lasting margin of the upper in advance of the roll 276 to afford a preliminary folding of said margin over the insole edge. The finger 178 is mounted, for adjustment as to its inclination both heightwise and widthwise of the shoe bottom, in a block 180 carried at one end of a bracket 182 itself supported for pivotal movement on the extension 259 of the support block 256. For effecting such pivotal movement, and thus movement of the finger heightwise of the shoe bottom, a piston-and-cylinder arrangement 184 is provided, also mounted on the extension 259 and acting on the bracket 182.

In the operation of the machine, after a shoe S has been placed upon the shoe support 10 while the latter is in its loading position, in sequence the shoe support 10 is swung into its operative position, determined by engagement of the heel end of the shoe with the heel band 14, and further is moved heightwise to bring the heel seat region thereof into engagement with the holddown 20. Thereupon the side lasting assemblies 28 are moved to their operative position, determined by engagement of the sensing fingers 104 with edges of the shoe bottom, thereby positioning both the sleeking rolls 206 and the fastener-inserting tools 64 in a correct relationship with the margins of the shoe bottom along which they are to operate progressively. It will of course be appreciated that the sensing fingers 104 are operative throughout the cycle of operation to position the tools 64 in the correct relationship with the marginal portions of the shoe bottom, following the contour thereof. It will also be appreciated that, as each assembly 230 moves inwardly as aforesaid, the non-rotary finger 178 thereof engages the lasting margin to perform a preliminary folding operation over the insole edge, and also the roll 276, which is at this time rotating, effects through its wiping element 282 an in-wiping action on the lasting margin and presses it against the insole margin. As can be seen from FIG. 3, the lasting roll operates "downstream" of the fastener-inserting tool 28, the direction of operation being from the heel breastline of the shoe bottom toewardly.

As the lasting rolls 276 are then caused to progress along the margins of the shoe bottom, because of the fact that this movement is achieved by pivoting the assembly about a vertical axis, as described above, the angle formed by the axis of each roll with the longitudinal centre line of the shoe bottom will vary along the length of the shoe and more specifically, the rolls will define arcs which correspond largely to the contour of the side portions of the shoe bottom. In practice, at the position of first engagement of the rolls with the shoe bottom, the axis of each thereof forms, with a line perpendicular to the longitudinal centre line of the operating locality of the machine, an angle of some 7.5°, while at the end position of each roll the angle formed with such line is in the order of 15°, the axis having at one stage passed through a position coincident with said line.

As the rolls progress toewardly from the heel breastline region, material forming part of the lasting margin tends to be drawn not only inwardly over the insole edge but also toewardly in advance of the advancing rolls so that, by the end of such traverse, in some instances a fold F of material is created between the roll and the already lasted forepart portion of the shoe upper. In order to prevent the fold F from being permanently formed in the lasting margin by the side lasting operation, which fold would be unacceptable in the finished shoe, not only because it renders subsequent shoe making operations more difficult, but also because it creates discomfort in wear, the machine has various modes of operation which involve the axial displacement of a selected one or both of the rolls 274 by the action of the piston-and-cylinder arrangement(s) 284 associated therewith upon reaching a predetermined position in the course of their operation along the sides of the shoe bottom.

Figure 2:
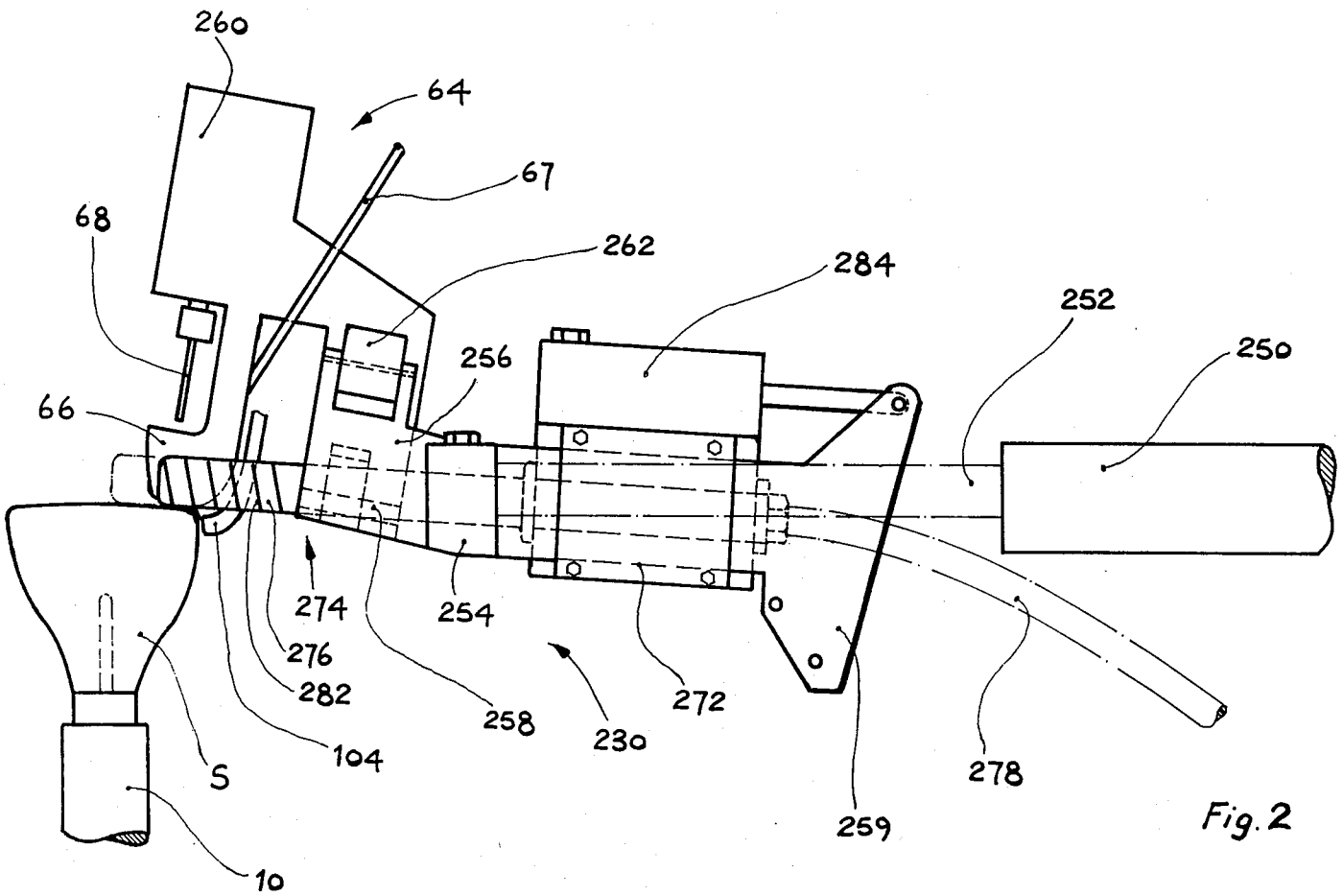
FIGS. 2 and 3 show details of one side lasting assembly of the machine of FIG. 1.

Thus, in a first mode of operation at or shortly before reaching its end position, each roll 274 is displaced axially inwardly relative to its associated fastener-inserting tool 28 over the insole edge to a position indicated in chain-dot line in FIG. 2 and thus effects an enhanced in-wiping movement on the lasting margin in that region by drawing the excess material further inwardly and thus effecting a desired material-spreading action. In order further to enhance this action, furthermore, the rate at which the lasting rolls move along the side portions of the shoe bottom may be reduced during such axial displacement, in which case such displacement is initiated before the end position of the roll is reached. Alternatively, the axial displacement of the rolls may be effected when the end position is reached; that is to say, the movement of the lasting roll along the shoe bottom is arrested upon initiation of the axial displacement thereof. This axial inward displacement of each roll also serves to counter any tendency of the roll to run off the shoe bottom as a result of its arcuate path.

In a second mode of operation only one of the two lasting rolls 274 effects such inward axial displacement, more particularly the roll which operates along the "outside" side region of the shoe bottom. In this case also the axial displacement takes place at or adjacent the ball region of the shoe bottom, with the longitudinal movement either at reduced speed or arrested, as in the case of the first mode of operation. Such axial displacement again serves to ensure that the "outside" roll 274 remains in an appropriate relationship to the shoe bottom at the ball region, as well as effecting a material-spreading function. It will of course be appreciated that, because of the convex shape of the shoe bottom at the "outside" thereof, additional material has to be wiped over, so that the risk of a fold being formed at the "outside" is increased.

In a third mode of operation the two rolls 274 are displaced inwardly, but at different times in the operating cycle. More particularly the roll 274 operating on the "inside" side portion is displaced axially inwardly immediately upon the rolls 274 being brought into engagement with the shoe bottom, that is to say at the heel breastline region, in response to the sensing of the edge of the shoe by the sensing finger 104 as aforesaid. This axial displacement thus serves to effect an additional inwiping force to the lasting margin at said region prior to the insertion of the first tacks. As the rolls 274 then operate progressively along the opposite side portions of the shoe bottom the "outside" roll 274 is also displaced axially at a predetermined position in the waist region of the shoe, that is to say at a position reached somewhat earlier than in the case of the first and second modes. More particularly, bearing in mind that the rolls 274 are caused to pivot about a vertical axis to effect their longitudinal movement relative to the shoe bottom, as hereinfore described, the axial inward displacement of the "outside" roll 274 takes place as the rolls lie with their axes parallel to one another, that is to say at a position lying approximately one third of the way along the path of the rolls 274. It has been found that, using this third mode, the initial displacement of the "inside" roll 274 ensures that a tighter wrapping of the upper about the last in the breast line region, which in turn has the effect of ensuring that the whole of the "inside" side portion of the upper is so positioned in relation to the insole/shoe bottom that the risk of a fold being formed therein is signficantly diminished. At the "outside", on the other hand, where the upper tends, because of the convexity of the shoe bottom, more readily to be conformed to the shoe bottom in the preceding pulling over and toe lasting operation, the axial displacement is delayed until a position is reached whereat the material-spreading function can be effectively performed. In some cases, it has been found to be beneficial to effect this function before the roll reaches the ball region, thereby enabling the material to be spread over a broader area of the shoe bottom; in this way the formation of a fold at the ball region can thus be avoided.

It will of course be appreciated that in still further circumstances, especially where the "inside" edge of the shoe bottom is sharply defined along the whole of its length, the initial inward displacement of the "inside" roll may be dispensed with in carrying out the third mode.

The machine also comprises control means whereby the various operations are caused to take place in sequence. Thus, in response to actuation of a "start" button (not shown), the side lasting instrumentalities 230 are moved to their operative position, as described above, and a first tack is then inserted by the fastener-inserting tools 64, one at each side of the shoe upper in the region of the breastline thereof, in response to the sensing of the edge of the shoe by the sensing fingers 104. The arcuate movement of the side lasting assemblies is then initiated, and the fastener-inserting tools 64 are caused intermittently to insert tacks along the length of the side portions of the shoe. For determining the end of the operating cycle an operator-settable valve or microswitch (not shown) is associated with each side lasting assembly 230 so as to be actuatable by a portion of the latter as it is moved along its path. In the first mode of operation, where the inward axial displacement of each roll 276 takes place at the end of the operating cycle, this valve or microswitch will be effective also to signal the piston-and-cylinder arrangement 284 to effect such inward displacement movement; where the axial inward displacement takes place before the end of the traverse of the rolls along the shoe bottom, a second valve or microswitch (also not shown) is provided for each side lasting assembly 230 and is similarly actuatable. This second valve or microswitch is also of course operator-settable, either independently of the first-mentioned valve or microswitch, or in common therewith.

In the second mode, the arrangement of switches can similarly be provided for effecting inward axial displacement of the "outside" roll 274. In addition, as also in the case of the third mode, it is necessary to determine, for any given cycle of operation, which is the "outside" edge of the machine. To this end the control means may include any suitable means such as has been proposed for sensing whether a shoe being operated upon is a left or a right; for example, bearing in mind that the shoe will be centralised, or substantially so, with its longitudinal centre line aligned with the longitudinal centre line of the heel seat lasting instrumentalities, the offset of the toe portion may be sensed, whether by positional sensors or by sensors montoring the position of the toe rest 18, which can pivot about a heightwise axis through a limited arc to accommodate left and right shoes. Alternatively, a simple operator-actuatable left/right switching arrangement, such as is described in GB-A No. 2126870 may be used; this arrangement may of course also be used for pivoting the toe rest 18 under power between "left shoe" and "right shoe" supporting positions.

In the third mode, as already mentioned, the inward axial displacement of the "inside" roll 274 is caused to take place upon actuation of its associated sensing finger 104. For causing the inward axial displacement of the "outside" roll to take place a third operator-settable valve or microswitch (not shown, but similar to the second such valve or microswitch provided for the first mode) is provided, located so as to be actuated at the appropriate time in the machine cyle.

It will of course be appreciated that, even where the rolls 274 are displaced inwardly at different times, or indeed where only one roll is so displaced, nevertheless a single second and a single third valve or microswitch will suffice to effect the function regardless of which roll constitutes the "outside" roll. Of course, if desired each roll may have a second and a third such valve or microswitch associated therewith, means being provided in the control means for rendering the appropriate valve active and the other inactive.

It will be appreciated that, whereas in the machine described above is the side lasting operation utilises fastener-inserting tools 64, the invention is equally applicable to so-called cement side lasting machines where the lasting rolls 276 are effective also to secure the lasting margin to the insole margin by pressing, using previously applied adhesive. Similarly, the invention is applicable to side lasting machines as well as combination side and seat lasting machines; it is also applicable in its broader aspects to combination toe and side lasting machines, especially where the heel seat region of the shoe has been lasted prior to presentation to such combination machine.

I claim:

1. A machine for lasting side portions of shoe uppers, said machine including:

a shoe support for supporting a shoe which includes a shoe upper on a last and an insole on the bottom of the last, said machine having two side lasting instrumentalities arranged one at each side of the shoe support, wherein each side lasting instrumentality comprises a wiper assembly comprising a lasting roll rotatable about an axis extending transversely of the bottom of a shoe supported by said shoe support and having a helical wiping element which engages the shoe upper for effecting an in-wiping force thereon as the roll rotates, which roll is supported by a housing mounted on a support for displacement movement relative thereto in a direction extending along the axis of rotation of said roll;

means for effecting rotation of said roll;

displacement means for effecting displacement movement of the housing relative to the support between an initial, retracted position and an advanced position, as aforesaid;

means for effecting relative movement between the shoe support and the supports carrying the housings for the lasting rolls to bring the lasting rolls, while each housing is in its retracted position, into operative engagement with the upper of a shoe supported by the shoe support and thereafter to cause said rolls to operate progressively along opposite side portions of the shoe bottom; and control means for controlling actuation of each of the displacement means whereby in accordance with a selected mode of operation, at least one of the housings, and thus the lasting rolls supported thereby, is moved at a predetermined region of the shoe bottom, inwardly towards the other housing from its retracted position to its advanced position and in so moving causes its lasting roll to effect an additional in-wiping force on the shoe upper at said region.

2. Machine according claim 1 wherein said one roll (276) which is displaced axially inwardly as aforesaid is constituted by the roll operating on the "outside" margin of the shoe bottom, the arrangement being such that it is so axially displaced when it reaches the ball region of the shoe bottom.

3. Machine according to claim 2 wherein both rolls (276) are displaced axially as aforesaid when they reach the ball region of the shoe bottom.

4. Machine according to claim 1 wherein said one roll (276) which is displaced axially inwardly as aforesaid is constituted by the roll operating on the "outside" margin of the shoe bottom, the arrangement being such that it is so axially displaced when it reaches the waist region of the shoe bottom.

5. Machine according to claim 4 wherein the lasting rolls (276) are mounted for pivotal movement about a heightwise axis thus to effect movement thereof, lengthwise of the shoe bottom, relative to the shoe support (10), whereby the rolls (276) are caused to operate progressively along opposite marginal portions of the shoe bottom as aforesaid and wherein the axis of each roll (276), as it pivots, passes through a position coincident with a perpendicular to the longitudinal centre line of the operating locality of the machine, and further wherein the roll (276) is displaced axially as aforesaid when it reaches the aforementioned position.

6. Machine according to claim 4 wherein the other roll (276), which operates along the "inside" margin of the shoe bottom is also displaced axially inwardly in response to its having been brought into engagement with the shoe bottom.

7. Machine according to claim 6 wherein a sensing finger (104) is associated with each roll (276) and is effective, upon sensing the edge of the shoe bottom by engagement therewith as the roll (276) is moved into operative position, to arrest such movement, thus determining said operative position, and wherein, in response to the sensing finger (104) sensing the edge of the shoe bottom, the "inside" roll (274) is displaced axially inwardly as aforesaid.

8. Machine according to claim 1 wherein the side lasting instrumentalities comprise two fastener-inserting tools (64), one associated with each lasting roll (276), each roll (276) and its associated tool (64) being movable together transversely of the shoe bottom whereby to follow the contour of the shoe bottom, and wherein, in effecting its axial displacement movement, at least one roll (276) moves inwards relative to its associated tool (64).

9. A machine for lasting side portions of shoe uppers comprising:

a shoe support for supporting, bottom uppermost, a shoe comprising a shoe upper on a last with an insole on the last bottom;

side lasting instrumentalities comprising two wiper assemblies arranged one at each side of the shoe support, and each comprising a rotary lasting roll extending transversely of the shoe bottom and having a helical wiping element which engages the shoe upper for effecting an in-wiping force thereon as the roll rotates;

means for effecting rotation of the rolls;

means for effecting relative movement lengthwise of the shoe bottom, between the shoe support and the side lasting instrumentalities to cause the lasting rolls to operate progressively along opposite side portions of the shoe bottom; and means for displacing axially inwardly toward the other roll at least one of the lasting rolls when it has reached a predetermined region in operating progressively along said shoe bottom, the speed of relative movement between the shoe support and the side lasting instrumentalties being reduced as inward displacement occurs such that the lasting roll dwells at said predetermined region whereby said inward displacement serves to tighten the upper over the insole in said region and spread said material over a wider area which would otherwise form a fold.

10. A machine for lasting side portions of shoe uppers comprising:

a shoe support for supporting, bottom upper most, a shoe comprising a shoe upper on a last with an insole on the last bottom;

side lasting instrumentalities comprising two wiper assemblies arranged one at each side of the shoe support, and each comprising a rotary lasting roll extending transversely of the shoe bottom and having a helical wiping element which engages the shoe upper for effecting a in-wiping force thereon as the roll rotates;

means for effecting rotation of the rolls;

means for effecting relative movement lengthwise of the shoe bottom, between the shoe support and the side lasting instrumentalities to cause the lasting rolls to operate progressively along opposite side portions of the shoe bottom; and means for displacing axially inwardly toward the other roll at least one of the lasting rolls when it has reached a predetermined region in operating progressively along said shoe bottom, the relative movement between the shoe support and the side lasting instrumentalities being arrested as inward displacement occurs such that the lasting roll dwells at said predetermined region whereby inward displacement serves to tighten the upper over the insole in said region and spread said material over a wider area which would otherwise form a fold.

* * * * *